US008847825B2

(12) United States Patent
Schadler

(10) Patent No.: US 8,847,825 B2
(45) **Date of Patent: *Sep. 30, 2014**

(54) HIGH-POWER-CAPABLE CIRCULARLY POLARIZED PATCH ANTENNA APPARATUS AND METHOD

(71) Applicant: Dielectric, LLC, Raymond, ME (US)

(72) Inventor: John L. Schadler, Raymond, ME (US)

(73) Assignee: Dielectric, LLC, Raymond, ME (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/765,229

(22) Filed: Feb. 12, 2013

(65) Prior Publication Data

US 2013/0147682 A1 Jun. 13, 2013

Related U.S. Application Data

(63) Continuation of application No. 11/882,383, filed on Aug. 1, 2007, now Pat. No. 8,373,597.

(60) Provisional application No. 60/836,398, filed on Aug. 9, 2006.

(51) Int. Cl.

| | |
|---|---|
| ***H01Q 1/38*** | (2006.01) |
| ***H01Q 1/00*** | (2006.01) |
| ***H01Q 9/04*** | (2006.01) |
| ***H01Q 19/00*** | (2006.01) |
| ***H01Q 1/42*** | (2006.01) |

(52) U.S. Cl.

CPC ..... *H01Q 19/005* (2013.01); *H01Q 9/0428* (2013.01); *H01Q 9/0435* (2013.01); *H01Q 1/42* (2013.01)

USPC ..... 343/700 MS; 343/833

(58) Field of Classification Search

None

See application file for complete search history.

(56) References Cited

U.S. PATENT DOCUMENTS

| | | | |
|---|---|---|---|
| 4,367,474 | A | 1/1983 | Schaubert et al. |
| 6,067,053 | A | 5/2000 | Runyon et al. |
| 6,239,750 | B1 | 5/2001 | Snygg |
| 6,396,442 | B1 | 5/2002 | Kawahata et al. |
| 6,462,710 | B1 | 10/2002 | Carson et al. |
| 6,806,845 | B2 | 10/2004 | Fund et al. |
| 6,943,737 | B2 | 9/2005 | Ryken et al. |
| 6,989,793 | B2 | 1/2006 | Van Der Poel |
| 7,209,080 | B2 | 4/2007 | Crouch et al. |
| 8,373,597 | B2 * | 2/2013 | Schadler ..... 343/700 MS |
| 2004/0145526 | A1 | 7/2004 | Puente Baliarda et al. |

OTHER PUBLICATIONS

Richard C. Johnson, ed: "Antenna Engineering Handbook," Third Edition, Georgia Institute of Technology, Atlanta, Georgia, pp. 28.21-28.24, McGraw-Hill, Inc., 1993.

* cited by examiner

*Primary Examiner* — Robert Karacsony

(74) *Attorney, Agent, or Firm* — Baker & Hostetler LLP

(57) ABSTRACT

A circularly polarized patch antenna uses a square quarter-wavelength conductive plate, spaced away from a slightly larger backing conductor. Excitation uses a coaxial feed stem pair, whereof respective inner conductors join the patch at orthogonal locations on a reference circle, and outer conductors intrude past points of joining to the backing conductor to establish gaps that interact with patch and backing conductor size and spacing to jointly establish terminal impedance. A parasitic element in the propagation path broadens bandwidth, while a frame behind serves to define a cavity reflector. A power divider behind the frame converts a single applied broadcast signal into two equal signals with orthogonal phase, which signals are delivered to the feed stems with equal-length coaxial lines.

20 Claims, 8 Drawing Sheets

AZIMUTH PATTERN
F = 698 MHz
HPOL = 64%

ELEVATION PATTERN
F = 698 MHz
VPOL = 80%

AZIMUTH PATTERN
F = 713 MHz
HPOL = 81%

ELEVATION PATTERN
F = 713 MHz
VPOL = 99%

AZIMUTH PATTERN
F = 722 MHz
HPOL = 83%

ELEVATION PATTERN
F = 722 MHz
VPOL = 94%

AZIMUTH PATTERN
F = 743 MHz
HPOL = 84%

ELEVATION PATTERN
F = 743 MHz
VPOL = 96%

CH1 Markers

| 2: 1.0246 | 3: 1.0391 | 4: 1.1029 |
|---|---|---|
| 713.000 000 MHz | 722.000 000 MHz | 746.000 000 MHz |

HIGH-POWER-CAPABLE CIRCULARLY POLARIZED PATCH ANTENNA APPARATUS AND METHOD

CLAIM OF PRIORITY

This application is a continuation of U.S. patent application Ser. No. 11/882,383 filed Aug. 1, 2007, now U.S. Pat. No. 8,373,597 issued Feb. 12, 2013, which application claims priority to U.S. Provisional Patent Application Ser. No. 60/836,398, titled "High-Power-Capable Circularly Polarized Patch Antenna Apparatus and Method," filed Aug. 9, 2006, both of which are hereby incorporated by reference in their entirety.

FIELD OF THE INVENTION

The present invention relates generally to radio frequency (RF) electromagnetic signal broadcasting antennas. More particularly, the present invention relates to single-feed circularly polarized broadband patch antennas for broadcasting.

BACKGROUND OF THE INVENTION

Auction of the 700 MHz spectrum, specifically the lower S-Band, by the Federal Communications Commission (FCC), resulting in part from a conversion of television broadcast from analog to digital service, has created a need for new products specifically tailored for this band. Some of the new license holders have begun rollout of a Digital Video Broadcast to Handheld (DVB-H) mobile TV entertainment service, along with other services. Receivers for these services will likely be integral parts of cellular telephones, accessories for notebook computers, or similar devices in at least a significant proportion of embodiments.

Circular polarization of broadcast signals reduces dependence on receiving antenna orientation for received signal strength, so that a simple dipole in virtually any orientation, for example, can receive a usable signal. This can be a significant consideration, ensuring that low-cost mobile handheld devices can realize stable and clear entertainment video and audio reception, as well as high digital data rates.

As in other broadcasting, it can be desirable to achieve particular extents of signal reception range, and to employ a small number of minimally-powered transmitters in the course of realizing that propagation. To these ends, radiating devices are preferably capable of exhibiting high gain and are preferably configurable with any of a variety of directionality options. Along with gain and propagation pattern, light weight and relatively small size may ease strength and wind load requirements for tower construction, allowing extra height above average terrain (HAAT), more bays, more radiators per bay, and the like.

In addition to considerations of circular polarization and high gain in broadcast antennas, higher power levels than previously required in the lower S-band are allowed in DVB-H service. Effective radiated power (ERP, a function of a transmitter's emitted signal power and antenna design and height that corresponds broadly to reception range) is regulated by the FCC. Transmitter power up to 5 kW is permitted under new DVB-H regulations, so broadcast antennas capable of supporting this power level may be appropriate in pursuit of optimization in the lower S-band. The new DVB-H regulations also imply desirability of an economical antenna solution in a compact package, in view of expectations that a nationwide infrastructure will be implemented.

Many broadcast antenna configurations exist. One that is usable and of merit for many applications includes elements variously referred to as patch style or panel style radiators. Typical known patch antennas are strongly directional, producing a pronounced lobe of emission in a principal (zero degrees relative azimuth) direction, with little or no emission to the sides (+/−90 degrees azimuth) and to the rear (180 degrees azimuth). Examples of emission patterns, including those known as cardioid (wherein the lobe diminishes gradually so that there is substantial but generally less emission to the sides than forward), skull (wherein there is negligible emission to the sides but a vestigial lobe to the rear), and multi-lobe (wherein a strong and narrow central lobe is bracketed by nulls and lesser lobes), will be addressed in the discussion that follows. Patch antenna elevation signal strength patterns are likewise frequently broadly cardioid, skull, or multi-lobe in shape for typical patch antennas.

Known patch antennas for low power applications may be relatively simple to implement. Within limits of materials, such antennas can be formed from sheet metal and insulating standoffs and can be fed using suitably sized connectors, coaxial lines, single conductors, and the like. Known radiative elements (radiators) may be square, shaped as incomplete rings, tee-shaped, formed as planar or bent bow-ties or bow-tie slots, or formed in numerous other configurations. At microwave frequencies (multiple gigahertz) and relatively low power per element, patch antennas can be made from dielectric layers (such as fiber-reinforced epoxy) and copper foil in much the same manner as circuit boards, trading off the dimensional and thermal limitations of the materials against high production rates and low costs. Limitations of many known designs generally focus on power handling per patch as a function of frequency; that is, element dimensions and interelectrode spacing decrease with wavelength, while voltage and current increase with power, so that a propensity for dielectric breakdown and arcing between components grows with power and frequency.

Circular polarization in known patch antennas can be realized using, for example, conductive, nearly-closed rings of about one wavelength circumference positioned above a planar reflector. Where several such rings are used to form an array, they can be connected with conductive rods to provide traveling wave feed. This particular design is severely limited in performance, however; see, for discussion, *Antenna Engineering Handbook, Third Edition*, R. C. Johnson, ed., McGraw-Hill, New York, 1993, pp. 28.21-28.24, and FIG. 28.25 therein.

Deficiencies in existing antenna designs for the 700 MHz band include excessive cost, narrow bandwidth capability (i.e., low voltage standing wave ratio (VSWR) does not extend over the entire allotted band, or even a substantial fraction thereof), lack of support for high broadcast transmitter power, uncertain wind load, and limited ability to provide circular polarization, in a directional panel antenna.

Some existing high power (up to 1 kW) circularly polarized panel antennas include crossed dipoles or log periodic radiators fed with hybrids and power dividers. The complexity of these styles of antennas can result in high cost for the achieved performance. Simpler configuration could potentially achieve a much lower cost than available products without sacrifice of performance or reliability.

SUMMARY OF THE INVENTION

The foregoing disadvantages are overcome, to a great extent, by the invention, wherein in one aspect an antenna is provided that in some embodiments of the invention affords lower cost, broad bandwidth capability, support for high broadcast transmitter power, low wind loading, and strong circular polarization in a directional panel antenna.

In a first embodiment, a circularly polarized patch antenna is disclosed. The antenna includes a first patch radiator, further including a substantially planar, conductive surface having extents proportional to a wavelength of an electromagnetic signal within a specified frequency band, wherein a positive direction along a first-patch reference axis, passing through a centroid of the first patch radiator perpendicular to the surface thereof, is parallel to a sole principal direction of propagation of signals emitted from the antenna. The antenna further includes a first feed point and a second feed point on the first patch radiator, located at prescribed locations with reference to dimensions of the radiator, and a power divider, configured to accept an applied broadcast signal on an input port and to provide a first two divider output signals, having prescribed relative phase and amplitude, on a first two output ports.

The antenna further includes interconnecting signal lines between the first two divider output ports and the first patch radiator feed points, wherein the lines have prescribed relative lengths, a first backing conductor, substantially parallel to the first patch radiator, wherein a distance from the first patch radiator to the first backing conductor is negative with reference to the principal direction of propagation of signals emitted from the antenna, and a first parasitic radiator, substantially parallel to the first patch radiator, wherein a distance from the first patch radiator to the first parasitic radiator is positive with reference to the principal direction of propagation of signals emitted from the antenna.

In a second embodiment, a circularly polarized patch antenna is disclosed. The antenna includes a radiative patch element for radiating an electromagnetic signal with circular polarization with a principal axis of propagation, wherein the patch excites signal currents having orthogonal phase along axes that are physically orthogonal within the patch. The antenna further includes a power divider for dividing applied signal power from a single source into two parts having substantially equal power, wherein the parts are orthogonal in phase. The antenna further includes coaxial feed stems for coupling the orthogonal electromagnetic signals onto the patch, wherein spatial locations within the patch whereto the signals are coupled are orthogonal with reference to a circle associated with the patch, wherein the circle is centered on the principal axis of propagation.

The antenna further includes a backing conductor for reducing radiation in a negative primary axial direction along the principal axis of propagation, wherein the backing conductor further functions to establish impedance of the patch at least in part. The antenna further includes, between the backing conductor and the patch, an intrusion of each feed stem outer conductor, terminating in a gap between the maximum extent of each feed stem and the patch, wherein the intrusion into a spatial volume associated with the interrelationship of the patch and the backing conductor further functions to establish impedance of the patch at least in part. The antenna further includes a parasitic radiator for parasitically broadening bandwidth of the patch, wherein the parasitic radiator is interposed along the principal axis of propagation in a positive primary axial direction, and feed lines for connecting the power divider to the feed stems.

In a third embodiment, a method for broadcasting circularly polarized signals is presented. The method includes providing a single signal encompassing at least one transmission channel within a prescribed broadcast band, applying the single signal to a coaxial input port of a power divider configured to present, at a first coaxial output port, a first divider output signal having a first phase angle, and further configured to present, at a second coaxial output port, a second divider output signal having a second phase angle, orthogonal to the phase angle of the first divider output signal. The method further includes conducting the orthogonal divider output signals to respective first and second coaxial feed stems, wherein the divider output signals are applied to inner conductors of the respective feed stems, and wherein outer conductors of the respective feed stems have a common potential with the power divider input signal port outer conductor and power divider output port outer conductors.

The method further includes conducting the orthogonal divider outputs through a backing conductor via the respective first and second coaxial feed stems, wherein the feed stem outer conductors are electrically joined to the backing conductor at locations thereon where the outputs are conducted therethrough, and conducting the orthogonal divider outputs to orthogonal points of attachment on a patch radiator, wherein the patch radiator is a substantially planar, square, conductive surface, parallel to and smaller than the backing conductor, having extents proportional to a prescribed portion of a wavelength of a frequency within the band of the antenna, wherein the points of attachment are orthogonal with reference to a circle of prescribed diameter in the plane of the patch radiator, centered on the centroid of the patch radiator, whereon the points of attachment fall, and wherein the feed stem outer conductors terminate proximal to the patch radiator with a prescribed gap therebetween.

There have thus been outlined, rather broadly, features of the invention, in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments, and of being practiced and carried out in various ways. It is also to be understood that the phraseology and terminology employed herein, as well as the abstract, are for the purpose of description, and should not be regarded as limiting.

As such, those skilled in the art will appreciate that the conception upon which this disclosure is based may readily be used as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

Figure 1:
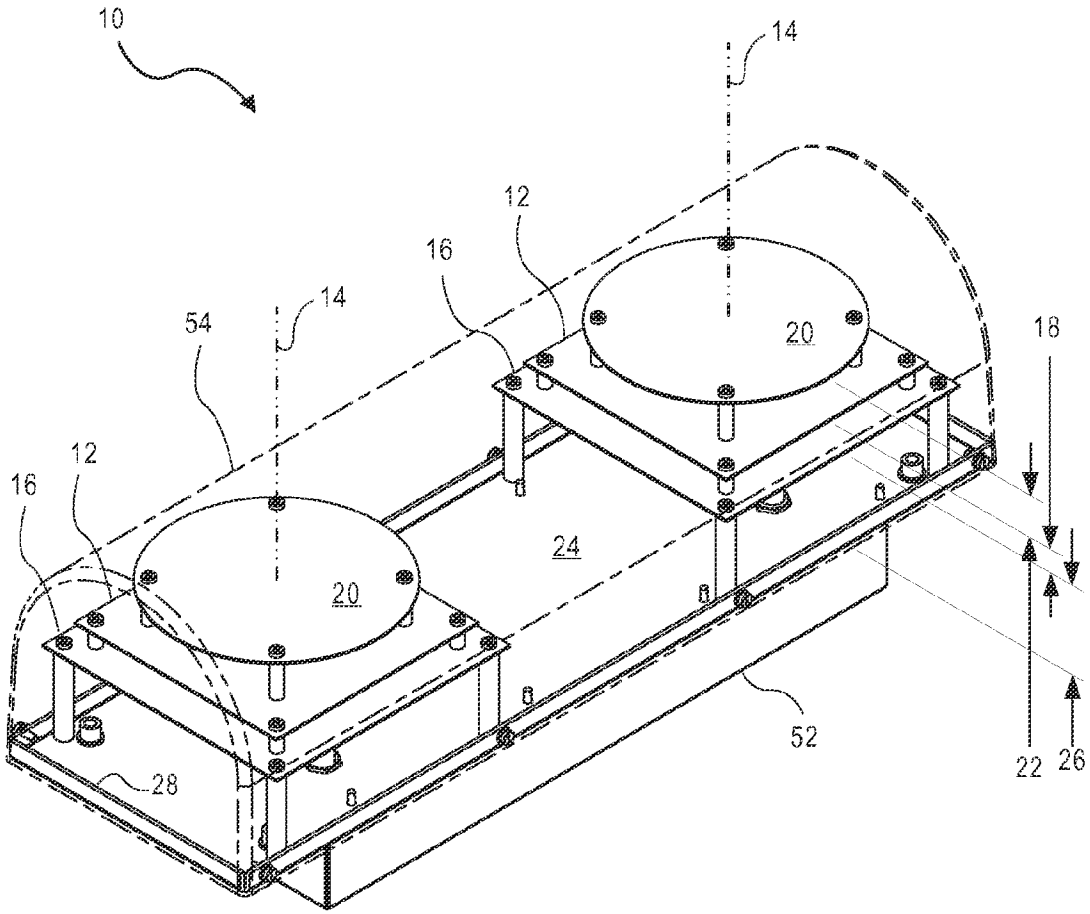
FIG. 1 is a first perspective view of an antenna according to the invention disclosed herein.

The invention will now be described with reference to the drawing figures, in which like reference numerals refer to like parts throughout. The invention provides an apparatus and method that in some embodiments provides a patch antenna for the lower 700 MHz band that emits a substantially single beam, circularly-polarized propagation pattern with high gain and relatively high power handling capability.

Typical patch antennas achieve directionality and impedance control in part by including a backing conductor. Without a backing conductor, a patch radiator exhibits an intrinsic property of emitting similar lobes before and behind (i.e., in the zero-azimuth and 180 degree-azimuth directions, with comparable elevation), known as a peanut pattern, and has an impedance that is a function of patch size and interaction with nearby conductors or free space. Square patches are commonly edge driven or center driven, as determined by the desired radiation pattern and by limitations of materials.

If a backing conductor is added in a plane parallel to that of the patch, with the backing conductor coextensive with the patch and larger than the patch to a greater or lesser extent, and if the backing conductor is connected to the outer conductor of a coaxial feed line whereof the patch is connected to the center conductor, the two parallel plate conductors exhibit a terminal impedance with respect to the coaxial line according to their dimensions and spacing, and the radiation pattern of the patch is substantially altered from that of a stand-alone equivalent. The interaction can cause the rear-directed lobe to be diminished and the forward-directed lobe to be increased.

The term "coextensive" as used herein refers to substantially similar geometric figures of comparable size, lying in parallel planes if planar, wherein lines perpendicular to the surfaces of the respective figures at respective centroids of the figures are approximately coincident. For nonplanar or complex coextensive figures, the approximate coincidence of lines perpendicular to and passing through centroids of the figures continues to apply, along with regular spacing and no contact between the figures. Nonplanar examples include concentric rotated parabolas, elliptical or cylindrical segments, or the like. Complex examples may include flat square bodies bounded by arcuate, dished perimeter surfaces, faceted surfaces of sufficiently similar shape to exhibit approximately uniform distributed electrical properties, and the like. For some such configurations, electrical characteristics may be well behaved, with impedance, electrical loading, emission, and the like well enough defined to permit their use for radiation of broadcast signals. For other configurations, transverse coupling may decrease suitability, at least for arrangements having a plurality of radiators. It may be observed that the antenna of FIG. 1 includes flat, thin components with minimal edge thickness, affording low transverse coupling.

FIG. 1 shows a perspective view of a directional antenna 10 having two patch radiators 12, in accordance with one embodiment of the invention. In order to overcome such limitations of typical patch antennas as low power and narrow band operation, the antenna 10 of FIG. 1, which may be sized for lower S-band operation, includes patch radiators 12 formed from a substantially flat and thin conductive material, having a square shape with dimensions perpendicular to the principal propagation axes 14 of the respective patches 12 approximating a half wavelength of a frequency within the intended passband of the antenna 10. The patches 12 are spaced away from grounded backing conductors 16 by a distance 18 that is a function of the desired terminating impedance of the radiators 12, in this instance roughly one-thirty-second of a wavelength, but generally requiring verification by test. The square shape of the patches 12 in the embodiment shown may be preferred for typical embodiments, although other proportions and shapes may be used. The relative dimensions of the patches 12 and backing conductors 16 similarly require verification for each embodiment: the backing conductors 16 in the embodiment shown are roughly 15% larger than the patches 12, which can further reduce rearward emission in some embodiments, although various size ratios may be used.

Each patch 12 is further associated with a single parasitic element 20, located on the propagation axis 14 in the direction of propagation, and electrically isolated from the patch 12 and the grounded backing conductor 16 by nonconductive fastenings. A single parasitic 20 can broaden bandwidth significantly, provided its size and spacing are suitable. In the embodiment shown, the parasitics 20 are round, and are equal in diameter to the respective edge lengths of the patches 12, although parasitics 20 of different shapes and sizes may be used. As in the case of the backing conductors 16, the distance 22 from each patch 12 to its parasitic 20 is a function of desired properties of the antenna 10—about a sixteenth of a wavelength in the embodiment shown, although other spacings may be used.

Additional parasitics 20, most often aligned with the other components of the respective radiators and located at selected distances from the patches 12, can further enhance bandwidth, gain, and other attributes of radiators in some embodiments. Tradeoffs in the pluralization of parasitics 20 include cost, size, weight, stability of structure and function over time, and diminishing returns of increased performance with increased complexity. To cite a strictly hypothetical example, if a second parasitic were to add 10% to overall performance according to some criteria, then a third might add 5%, a fourth 2%, and the like, while antenna material cost increased by 8% per parasitic, wind loading by 3%, and so forth. Thus, in some embodiments, particularly those wherein an antenna's requirement for enhanced radiative performance outweighs some other considerations, two or more parasitics 20 may be preferred. The presentation of a single parasitic 20 in the present disclosure should be viewed as representative, and not construed as limiting.

Figure 2:
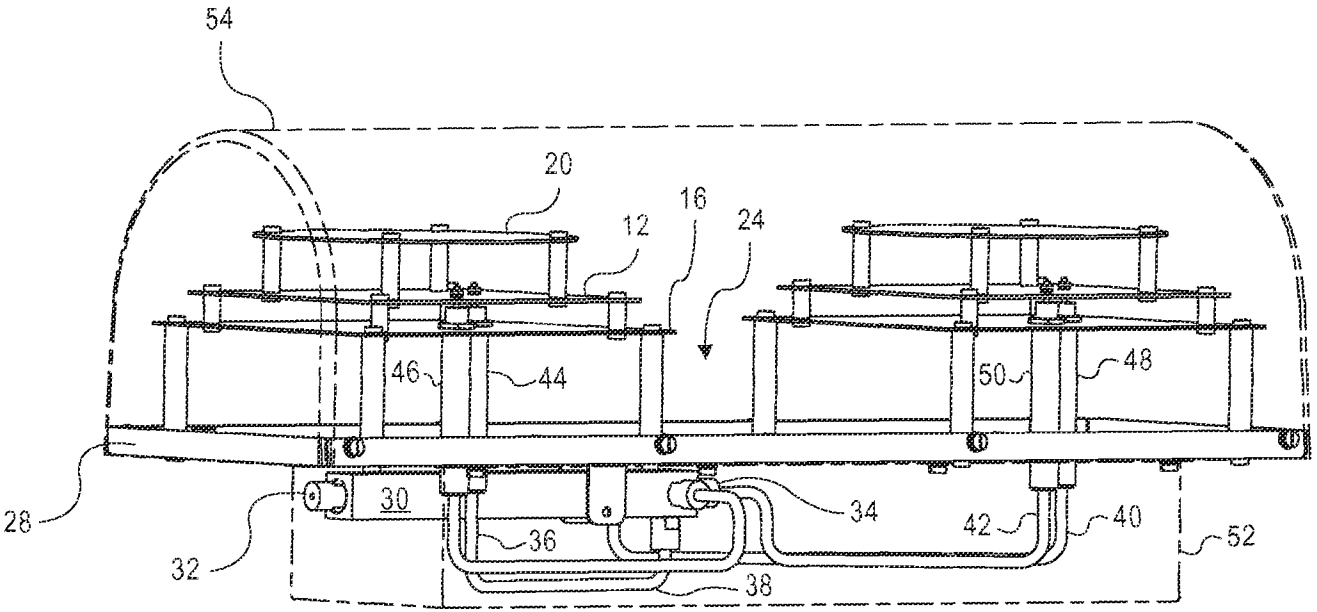
FIG. 2 is a second perspective view of an antenna according to the invention disclosed herein.

FIG. 2 shows certain of the following elements with greater clarity; those also shown in FIG. 1 may be identified there as well. Behind (i.e., opposite to the principal propagation direction of) each assembly of a patch 12, a backing conductor 16, and a parasitic 20 is a frame 24. This frame 24 is another generally planar, grounded, conductive surface, spaced away from the backing conductor 16 by a distance 26 approximating a quarter wavelength in the example shown.

It is to be understood that a signal propagating from the patch 12 toward the frame 24 has opposite handedness of circular polarization to a signal propagating in the desired (positive) direction. As a consequence of reflecting the negative-going signal, the frame 24 reverses the signal's polarization, so that the reflected signal has common polarization with and is propagating in the same direction as the signal originating from the patch 12 in the positive direction. The reflected signal returning to the patch 12 is retarded by one half wave, but the patch 12 has reversed phase by one half cycle in the interval, so that the signal reflected from the frame 24 reinforces the forward-directed signal.

In the embodiment shown, the frame 24 is formed from flat sheet metal by cutting and by bending up fins 28 to establish a shallow box shape, variously known in the art as having a basket shape or as establishing a cavity-backed antenna. In other embodiments, the material and configuration of the frame 24, or indeed its presence, may differ, such as by using perforated or expanded metal, mesh, or another material reflective in the frequency range of interest.

When the antenna 10 is excited, the region between the backing conductors 16 and the frame 24 is hot—that is, contains relatively high field gradients—despite the backing conductors 16 being at roughly the same potential as the frame 24. As a result, the configuration of any conductors in that space tends to affect the overall emission pattern of the antenna 10. Therefore, any conductors in this region are preferably highly stable and uniform in configuration, and any signals coupled through this region shielded, in order to assure predictable performance. Each dimension of the frame 24, as well as the spacing to the radiative parts, is subject to verification for a specific embodiment.

The space behind the frame 24 is relatively shielded from radiation. Into this space in the embodiment shown are placed a power divider 30 having an input connector 32 and sufficient output connectors (concealed by mating cable-end connectors 34 or obscured by the divider 30 in FIG. 2) to provide feed signals to the patches 12. Split-off signal portions are carried by interconnecting signal lines to the patches 12, with the interconnecting signal lines made up of respective coaxial feed lines 36, 38, 40, and 42 and coaxial feed stems 44, 46, 48 and 50. An overall enclosure 52, shown in phantom and mounted to the frame 24, covers the divider 30 and the feed arrangement, with the input connector 32 protruding through the enclosure 52 in the embodiment shown in FIG. 2. The enclosure 52 may be conductive in some embodiments, thereby affording additional radiation uniformity, protection, and like benefits. A radome 54 provides overall mechanical protection of the radiating parts against wind force, wind-blown matter, rain, icing, and like hazards, and establishes in part a uniform and quantifiable wind drag characteristic. The mailbox-shaped radome 54, shown in phantom and mounted to the frame 24, is preferably fairly light in weight, strong, and resistant to sunlight and pollutant degradation, while substantially transparent to radio emissions in the frequency band of the antenna 10 to a desirable extent.

The divider 30 provides four outputs in the embodiment shown. These outputs may be equal in phase, magnitude, and spectral content in some embodiments. In other embodiments, while otherwise equal, each two outputs may differ in phase by 90 degrees or another amount, as discussed below. Similarly, the coaxial feed lines 34, 36, 38, and 40 may differ by a quarter wavelength, may be equal in length, or may differ by another amount, as also discussed below. All conductive parts other than the inner parts of the divider 30, the inner conductors of the feed lines 34, 36, 38, and 40 and stems 44, 46, 48 and 50, the patch radiators 12, and the parasitics 20, are connected electrically, and thus are approximately at a common ground potential presented to the antenna on the outer conductor of the input connector 32 to the divider 30.

Figure 3:
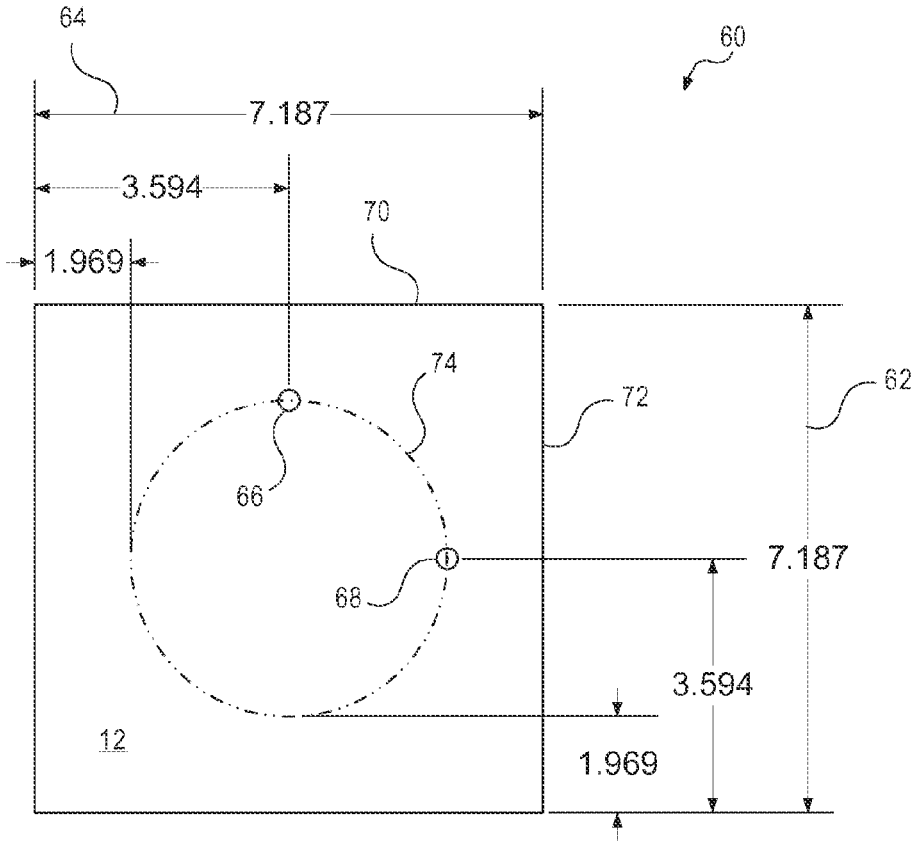
FIG. 3 is a face view of one principal radiator component and a parasitic component according to one embodiment of the invention.

FIG. 3 is a schematic diagram 60 showing a surface of a representative patch 12 having equal height 62 and width 64, with the direction of propagation toward the viewer. For convenience, an approximate value for a speed of propagation of electromagnetic signals in the vicinity of the antenna of 0.88 times the speed of light is used herein. It is to be understood that this approximation is a function of the physical properties of the components and materials of the antenna, and that this velocity differs, for example, within coaxial cables filled with a dielectric material, along conductive surfaces spaced apart from other conductive surfaces and separated by air, and the like. The dimensions in FIG. 3, in inches, are approximately those used in the prototype antenna discussed below. The patch 12 is about a quarter-wavelength on each edge at 722 MHz at the assumed propagation velocity.

The patch radiator 12 achieves circular polarization by receiving the applied signal at two feed points 66 and 68, each placed midway along one of two orthogonal edges 70 and 72 of the patch 12 and inward from the respective edges 70 and 72, effectively placed on a feed point reference circle 74, centered on the patch radiator 12 and having a specified diameter. If the signals applied to the feed points 66 and 68 are orthogonal in phase, that is, are two samples of a single signal, substantially identical but differing in phase by one-quarter wave (90 degrees), they establish currents in the patch 12 with separate and orthogonal phase in space and time, which couple out of the patch 12 as a single signal propagating with circular polarization. To the extent that stations at which the feed points 66, 68 are placed have nonorthogonal angular and/or radial separation with respect to the reference circle 74, or that the phase and/or strength of the applied signals are not orthogonal/identical as indicated above, polarization may be elliptical, i.e., ellipticity will vary from a value of one.

All of the indicated physical dimensions, in addition to signal phase, strength, and spectral equivalence, affect antenna performance. Spacing between and dimensions of the backing conductor 16, parasitic 20, frame 24, and fins 28, shown in FIGS. 1 and 2, and feed point placement along the respective edges 70 and 72 (described above as midway, although other orientations may be used), as well as feed point reference circle diameter 74, affect emission.

Figure 4:
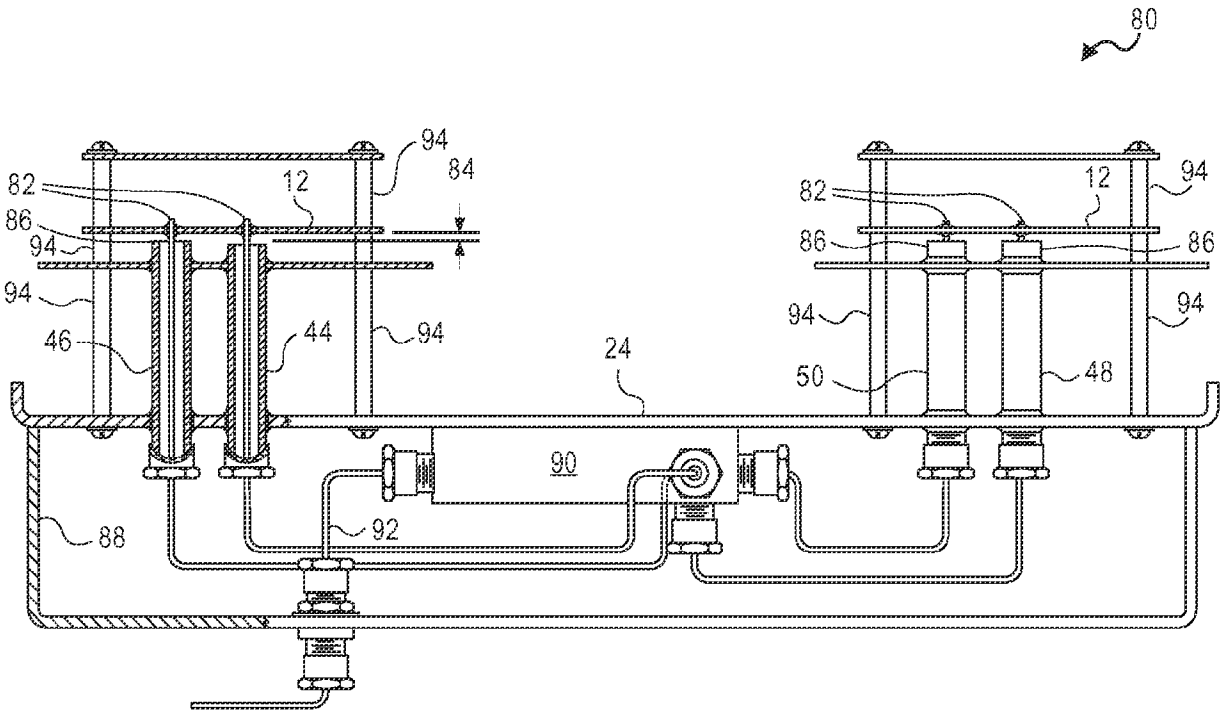
FIG. 4 is a side elevation in partial section illustrating features of the patch antenna of FIGS. 1 and 2.
Figure 5:
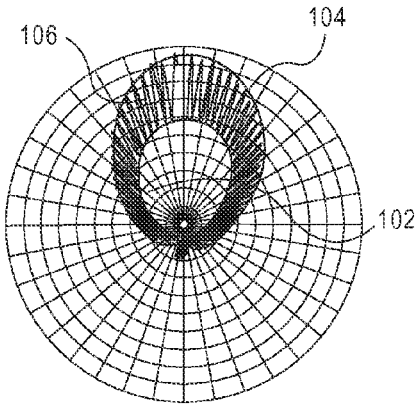
FIGS. 5-12 are test charts representing gain and axial ratio versus azimuth and elevation at representative frequencies across a working band for a single patch antenna according to the invention disclosed herein.
Figure 6:
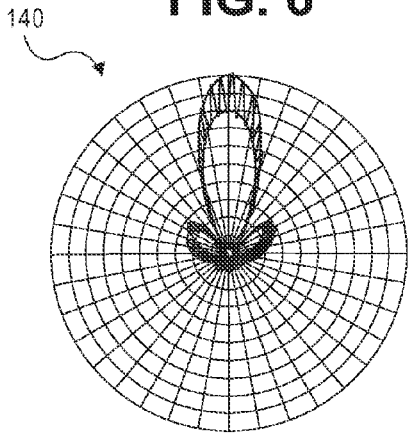
Figure 7:
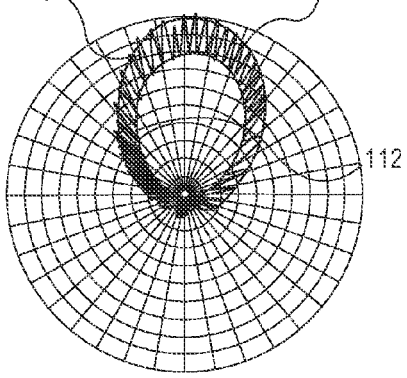
Figure 8:
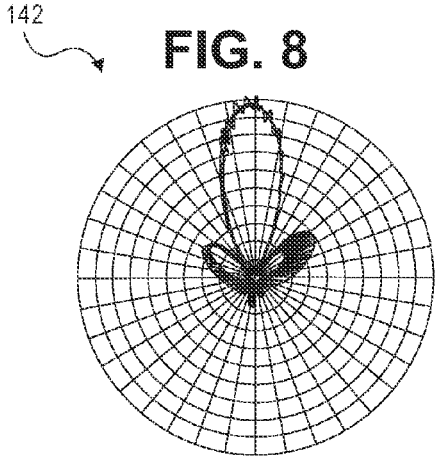
Figure 9:
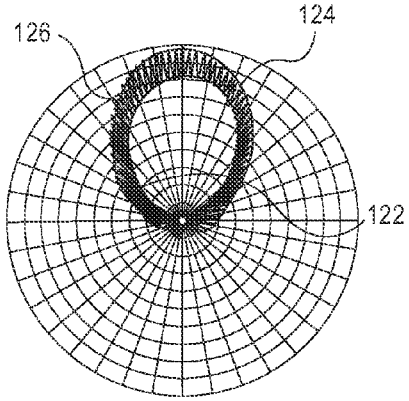
Figure 10:
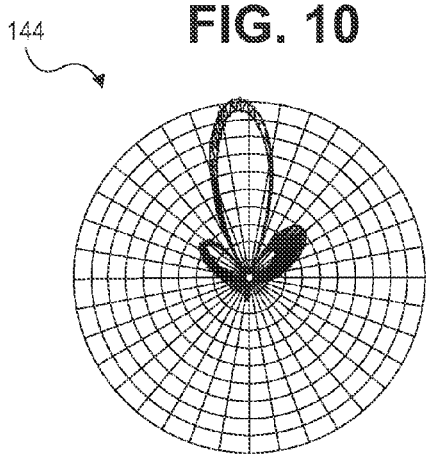
Figure 11:
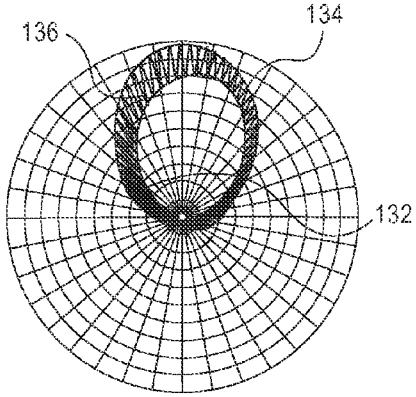
Figure 12:
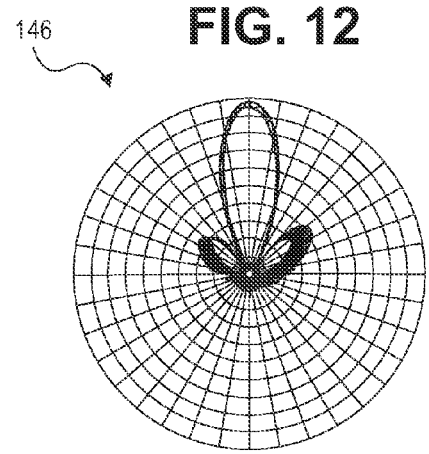

FIG. 4 is a schematic side view 80 of an antenna 10 according to the invention, shown in partial section. In this view, it may be seen that the outer conductors of the coaxial feed stems 44, 46, 48 and 50 are electrically and mechanically joined by a suitable method to the frame 24 and the backing conductors 16, and end with gaps 84 between respective termination loci 86 and the patches 12. The inner conductors 82 of the coaxial feed stems 44, 46, 48 and 50 are electrically joined by a suitable method to the respective patches 12. The joining methods illustrated in FIG. 2 are nuts over threaded tubes or rods; FIG. 4 suggests soldering, brazing, welding, or a combination of such methods. Methods appropriate to an embodiment may be determined in part by the selection of materials for the radiative elements, power levels, tradeoffs between cost and reparability, and the like.

The gap distances 84 between the respective outer conductors of the coaxial feed stems 44, 46, 48 and 50 and the patches 12 represent factors affecting the impedance of the signal paths over frequency. The divider 30, the associated feed lines 36, 38, 40, and 42, and the coaxial feed stems 44, 46, 48 and 50 may be configured to provide relatively uniform impedance, such as fifty ohms, through choice of dimensions, dielectrics, and like factors. Similarly, size and spacing between the patches 12 and the backing conductors 16 and placement of the feeds (inner conductors 82) on the patches 12 may be defined to control signal emission and polarization, as well as impedance, over a selected frequency range. The gaps 84 function as transformers whereby the feed components (divider, coaxial lines, feed stems) and the radiative components (patches, backing conductors, parasitics, and the frame) can be integrated to provide low voltage standing wave ratio (VSWR) over a broad bandwidth, while permitting high power to be applied and emitted.

The enclosure 88 shown in FIG. 4 houses a power divider 90 differing in shape from the divider 30 of FIG. 2, with an additional feed line 92. It is to be understood that any arrangement of components that meets the operational description herein is included.

Mounting standoffs 94 are incorporated in order to position the conductive components relative to one another. The configuration shown is one of many practical styles. Multiple slender, non-conductive posts having opposite-sex screw threads on respective ends, as shown in some parts of the standoff 94 arrangement, allow conductive elements to be assembled with relatively low complexity, using a single small-diameter hole in each conductive component at each post location, stacking the posts to the extent practical, and completing assembly with screws as required. Suitable materials for such posts include at least polymers and ceramics. The materials may be reinforced with fibers or other filler materials or unfilled, and resilient or rigid, depending on considerations relevant to specific applications, such as vibration, temperature, electromagnetic radiation level, and the like. Dielectric constants and dissipation factors of selected materials may affect signal distortion, signal power loss through conversion to heat, and other effects of the mounting provisions. Conductive or semiconductive materials may be suited to some applications at least in part. Configurations other than the standoffs 94 shown in the figures, including clip-retained (non-threaded) fittings otherwise generally similar to the threaded posts shown, a single central post stack per patch, slotted or relieved frameworks external to the conductive parts, retention fittings molded or bonded into the radome, and other types may prove practical in some embodiments. The feed stems may contribute a portion of overall structural strength in some embodiments.

FIGS. 5-12 are charts showing measured test results for a prototype antenna in a standard test range. FIGS. 5, 7, 9, and 11 show azimuth performance for a single antenna 10 (two patches 12, one divider 30, and associated parts) as a function of polarization, using the customary procedure of transmitting a series of single-channel signals from the antenna 10 under test while slowly rotating it. A linearly polarized receiving antenna located at a single azimuth in far field is oriented to detect horizontal polarization, then subsequently vertical polarization, and finally is rotated rapidly (in comparison to the transmitting antenna rotation rate) to detect the axial ratio of the antenna under test.

The respective horizontal polarization envelopes 102, 112, 122, and 132 were detected at low, intermediate, and high frequencies within the 700 MHz to 750 MHz band. The directivity and uniformity of directivity over frequency are evident. Gain is normalized in the plots.

The respective vertical polarization envelopes 104, 114, 124, and 134 at the same frequencies are also shown to be highly uniform, and comparable to the horizontal envelopes. Measured axial ratio at zero degrees off axis remains above 0.6 at the lowest frequency and exceeds 0.8 over most frequencies, decreasing to roughly 0.5 at 30 degrees off axis at the low end The remaining curves 106, 116, 126, and 136 demonstrate that there is substantially continuous and uniform circular polarization, rather than isolated horizontally and vertically polarized elements alone.

FIGS. 6, 8, 10, and 12 chart performance of the prototype versus elevation, with testing performed by mounting the transmitting antenna prototype on its side and using substantially the test setup of FIGS. 5, 7, 9, and 11 otherwise. Chart measurements 140, 142, 144, and 146 are clearly similar to corresponding azimuth measurements, with the two patch radiators reinforcing to provide increased vertical directivity—narrower relative beam width due to the presence of two wavelength-spaced radiators—at some cost in developing side lobes with nulls around 25 to 35 degrees off axis and peaks in the vicinity of 60 degrees off axis for the entire band. Measured axial ratio at zero degrees elevation exceeds 0.8 at all frequencies, and generally improves off-axis.

Figure 13:
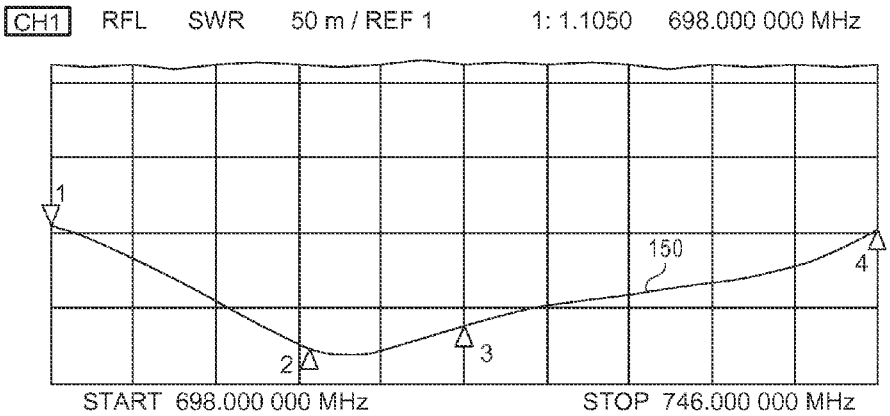
FIG. 13 is a test chart representing voltage standing wave ratio (VSWR) versus frequency for a single patch antenna according to the invention disclosed herein.

FIG. 13 graphs VSWR versus frequency, with the plot line 150 showing that markers 1 (698 MHz, VSWR=1.1050), 2 (713 MHz, VSWR=1.0246), 3 (722 MHz, VSWR=1.0391), and 4 (746 MHz, VSWR=1.1029) demonstrate an ability of an antenna according to the invention to accept and radiate power that is exceptionally broadband (near 1.1 VSWR for 6.65% bandwidth) for a patch design in general or for a broadcast antenna for use in the lower 700 MHz band.

The provision of four-way power division within the patch antenna 10 assembly, the addition of four rigid coaxial feed stems delivering signal energy to the patches 12, the distance from the patches 12 to the backing conductor 16 and other grounded surfaces, and the absence of masses of dielectric material between the backing conductor 16 and the patch 12 all permit increased power handling compared to previous patch antenna designs, while providing uniform broad-band performance.

Figure 14:
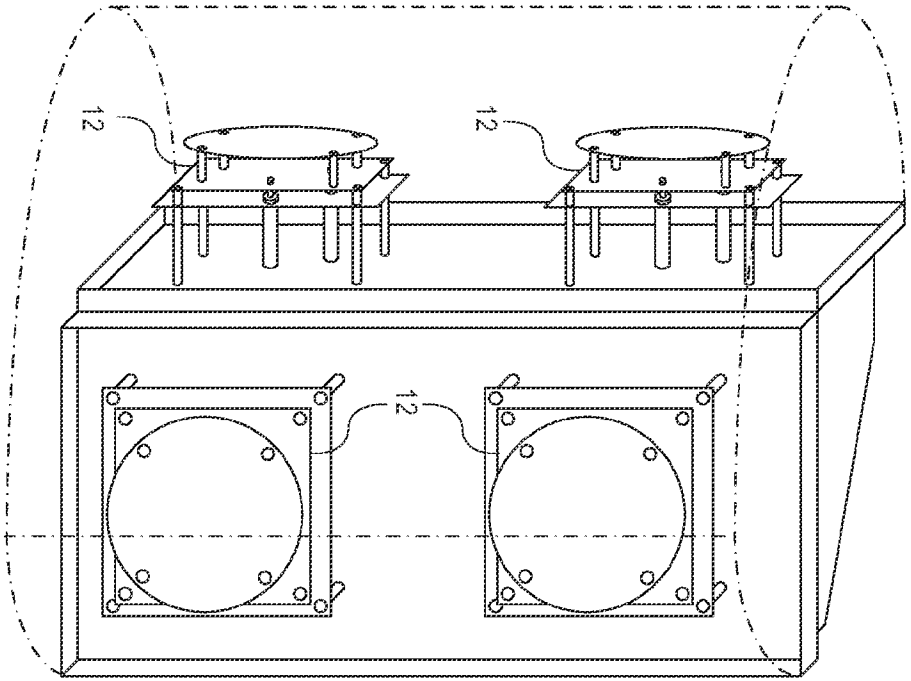
FIG. 14 is a perspective view of another embodiment of an antenna according to the invention disclosed herein.

A single antenna assembly according to the indicated embodiment of the invention includes a doublet of patches 12 scaled specifically for the lower 700 MHz band and enclosed in a mailbox shaped radome. Such a configuration affords comparatively low wind load while managing complexity. Single patches within radomes, as opposed to the doublet configuration shown, use twice the external feed complexity (power dividers, cables) of the doublets, and have increased housing surface area and thus wind load. Placing three or more patches within each radome is likewise feasible, further reducing wind loading. Placing four patches in a two-dimensional planar array within a single radome, for example, may be preferred for so-called sector type service, but may be incompatible with some omnidirectional applications where transmitter power output is modest. The same four patches 12, placed at angles to one another, as shown in FIG. 14, may provide wider azimuthal coverage while reducing configuration complexity by incorporating coaxial lines into the assembly, again at a cost of providing an eight-way divider, two four-ways preceded by a two-way, or an equivalent power distribution arrangement.

Note that 0 degree and −90 degree feed lines are provided to feed the patches 12 as shown in FIGS. 1 and 2, an arrangement that produces circular polarization. If the 0, −90 degree phasing is provided within the power divider 30 and the feed lines are equal in length, then, for at least some configurations of divider, impedance cancellation at the divider may be realized. To the extent to which the divider appears nonreactive to its input over the band of interest, this impedance cancellation can improve divider, and thus antenna, bandwidth. In the alternative, the 0, −90 phase relationship may be realized using differential lengths of the feed lines. The latter arrangement renders impedance cancellation within the divider 30 more difficult. In addition, phasing that is realized using feed line length tends to vary more greatly over the working band. Thus, reliance on differential feed line length for setting phase tends both to lower uniformity of phase circularity over frequency and to narrow antenna bandwidth.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A circularly polarized patch antenna, comprising: a first patch radiator, comprising a substantially uniform, conductive surface having extents proportional to a wavelength of an electromagnetic signal of the antenna, wherein a positive direction along a first-patch reference axis, passing through a centroid of the first patch radiator perpendicular to the surface thereof, is parallel to a principal direction of propagation of signals emitted from the antenna; a first coaxial feed point and a second coaxial feed point on the first patch radiator; a first backing conductor, substantially parallel to and coextensive with the first patch radiator; a first parasitic radiator, substantially parallel to and aligned with the first patch radiator; a second patch radiator, substantially identical to and oriented equivalently to and coplanar with the first patch radiator is parallel to the principal direction of propagation of signals emitted from the antenna; a third coaxial feed point and a fourth coaxial feed point on the second patch radiator; a second backing conductor, substantially parallel to and coextensive with the second patch radiator; a second parasitic radiator, substantially parallel to and aligned with the second patch radiator; a power divider, configured to accept an applied broadcast signal on a coaxial input port and to provide a first two divider output signals on a first two divider coaxial output ports, and a second two divider output signals on a second two divider coaxial output ports; first two interconnecting coaxial signal lines between the first two coaxial output ports of the power divider and the radiator coaxial feed points of the first patch radiator; second two interconnecting signal lines between the second two coaxial output ports of the power divider and the radiator coaxial feed points of the second patch radiator; a conductive frame distal to the parasitic radiator and located further from the first patch radiator than is a backing conductor; and passage apertures through the frame for coaxial feed stems at prescribed locations, wherein the respective feed stem outer conductors are connected electrically and mechanically to the frame at the passage locations; wherein the respective interconnecting signal lines include: coaxial feed stems that pass through the first backing conductor, with electrical connections therebetween substantially coinciding with the first backing conductor passthrough locations, coaxial feed lines directed from the first two divider output ports to respective inputs of the coaxial feed stems, termination loci for respective coaxial feed stem outer conductors, located between the first backing conductor and the first patch radiator, and respective coaxial feed stem inner conductors that extend from the feed lines through the respective feed stem outer conductors, beyond the termination loci, and connect to the first patch radiator at the respective feed points, and wherein spacing along the principal propagation axis between the first backing conductor and the first patch radiator is less than one wavelength of a frequency in a range of the antenna, between the first patch radiator and the first parasitic radiator is less than one wavelength of a frequency in the range of the antenna, and between the first backing conductor and the frame is approximately one quarter of a wavelength of a frequency in the range of the antenna.

2. The antenna of claim 1, wherein the first patch radiator is substantially square in shape and has overall edge lengths of approximately one-haft wavelength of a frequency within a band, wherein the first backing conductor is substantially equal in configuration to and larger by at least zero and at most one hundred percent in edge length than the first patch radiator, and wherein the first parasitic radiator is substantially circular in shape, with a diameter approximately equal to one edge length of the first patch radiator.

3. The antenna of claim 1, wherein the power divider is so configured that the first two output signals differ in phase by approximately ninety degrees, wherein the feed points of the first patch radiator are angularly separated by approximately ninety degrees of arc on a common reference circle centered on the centroid of the radiator, wherein the reference circle has a diameter from one-quarter to three-quarters of the width of the first patch radiator, and wherein the relative lengths of the first and second interconnecting signal lines are substantially equal.

4. The antenna of claim 1, further comprising: a radome, substantially transparent to electromagnetic radiation in the specified frequency band.

5. The antenna of claim 4, wherein the impedance, coupling efficiency, gain, and axial ratio of the antenna are determined, at least in part, by the first patch radiator feed point locations, which points are located at prescribed stations on a feed point reference circle and centered on the first-patch reference axis, by a diameter of the reference circle, by angular separation of the stations, by angular positions of the stations with reference to the shape of the first patch radiator, by the overall dimensions of the first patch radiator, backing conductor, parasitic radiator, and frame, by the distances between the first patch radiator, backing conductor, parasitic radiator, and frame along the propagation axis, and by the gap distances associated with the respective feed stems.

6. The antenna of claim 4, wherein the frame further comprises a plurality of fins connected to the frame at respective extents of the fins and the frame, wherein the fins are oriented at least in part toward the principal direction of propagation, wherein the fins have substantially uniform height above the frame parallel to the first-patch axis in a direction of propagation, and wherein the respective connections between the respective fins and the frame are substantially parallel to proximal edges of the first patch radiator at least in part.

7. The antenna of claim 4, wherein the first patch radiator, first backing conductor, first parasitic, and the frame are maintained in a fixed spatial configuration with at least one mounting standoff, wherein the at least one mounting standoff is substantially nonconductive and exhibits dissipation and distortion of electrical energy in the frequency range of the antenna sufficiently low to permit operation of the antenna with a prescribed power level.

8. The antenna of claim 4, further comprising a conductive enclosure surrounding the power divider and the interconnecting feed lines at least in part, and positioned distal to the first patch radiator with reference to the frame.

9. The antenna of claim 1, wherein the power divider further comprises a second two output ports, substantially identical to the first two output ports, having prescribed signal levels and phase characteristics.

10. The antenna of claim 1, wherein the respective principal axes of the first and second patch radiators are separated by approximately one wavelength of a frequency within the passband of the antenna.

11. The antenna of claim 1, wherein the first and second interconnecting signal lines, as measured in wavelengths of a frequency in the antenna passband, with reference to a common point at the input to the power divider, measuring therefrom to the respective feed points at the first patch radiator, differ in electrical length by a prescribed portion of a wavelength at the respective feed points of the first patch radiator, corresponding to a relative phase delay sufficient to induce emission with circular polarization with a specified value of handedness.

12. A circularly polarized patch antenna, comprising: a first patch radiator, comprising a substantially uniform, conductive surface having extents, wherein a positive direction along a first-patch reference axis, passing through a centroid of the first patch radiator perpendicular to the surface thereof; a first coaxial feed point and a second coaxial feed point on the first patch radiator; a first backing conductor, substantially parallel to and coextensive with the first patch radiator; a first parasitic radiator, substantially parallel to and aligned with the first patch radiator; a second patch radiator, substantially identical to and oriented equivalently to and coplanar with the first patch radiator is parallel to the principal direction of propagation of signals emitted from the antenna; a third coaxial feed point and a fourth coaxial feed point on the second patch radiator; a second backing conductor, substantially parallel to and coextensive with the second patch radiator; a second parasitic radiator, substantially parallel to and aligned with the second patch radiator; a power divider, configured to accept an applied broadcast signal on a coaxial input port and to provide a first two divider output signals on a first two divider coaxial output ports, and a second two divider output signals on a second two divider coaxial output ports; first two interconnecting coaxial signal lines between the first two coaxial output ports of the power divider and the radiator coaxial feed points of the first patch radiator; second two interconnecting signal lines between the second two coaxial output ports of the power divider and the radiator coaxial feed points of the second patch radiator; a conductive frame distal to the parasitic radiator and located further from the first patch radiator than is a backing conductor; and passage apertures through the frame for coaxial feed stems at prescribed locations, wherein the respective feed stem outer conductors are connected electrically and mechanically to the frame at the passage locations; wherein the respective interconnecting signal lines include: coaxial feed stems that pass through the first backing conductor, with electrical connections therebetween substantially coinciding with the first backing conductor passthrough locations, coaxial feed lines directed from the first two divider output ports to respective inputs of the coaxial feed stems, termination loci for respective coaxial feed stem outer conductors, located between the first backing conductor and the first patch radiator, and respective coaxial feed stem inner conductors that extend from the feed lines through the respective feed stem outer conductors, beyond the termination loci, and connect to the first patch radiator at the respective feed points, and wherein spacing along the principal propagation axis between the first backing conductor and the first patch radiator is less than one wavelength of a frequency in a range of the antenna, between the first patch radiator and the first parasitic radiator is less than one wavelength of a frequency in the range of the antenna, and between the first backing conductor and the frame is less than one wavelength of a frequency in the range of the antenna.

13. The antenna of claim 12, wherein the first patch radiator is substantially square in shape and has overall edge lengths of approximately one-half wavelength of a frequency within a band, wherein the first backing conductor is substantially equal in configuration to and larger by at least zero and at most one hundred percent in edge length than the first patch radiator, and wherein the first parasitic radiator is substantially circular in shape, with a diameter approximately equal to one edge length of the first patch radiator.

14. The antenna of claim 12, wherein the power divider is so configured that the first two output signals differ in phase by approximately ninety degrees, wherein the feed points of the first patch radiator are angularly separated by approximately ninety degrees of arc on a common reference circle centered on the centroid of the radiator, wherein the reference circle has a diameter from one-quarter to three-quarters of the width of the first patch radiator, and wherein the relative lengths of the first and second interconnecting signal lines are substantially equal.

15. The antenna of claim 12, further comprising: a radome, substantially transparent to electromagnetic radiation in the specified frequency band.

16. The antenna of claim 15, wherein the impedance, coupling efficiency, gain, and axial ratio of the antenna are determined, at least in part, by the first patch radiator feed point locations, which points are located at prescribed stations on a feed point reference circle and centered on the first-patch reference axis, by a diameter of the reference circle, by angular separation of the stations, by angular positions of the stations with reference to the shape of the first patch radiator, by the overall dimensions of the first patch radiator, backing conductor, parasitic radiator, and frame, by the distances between the first patch radiator, backing conductor, parasitic radiator, and frame along the propagation axis, and by the gap distances associated with the respective feed stems.

17. The antenna of claim 15, wherein the frame further comprises a plurality of fins connected to the frame at respective extents of the fins and the frame, wherein the fins are oriented at least in part toward the principal direction of propagation, wherein the fins have substantially uniform height above the frame parallel to the first-patch axis in a direction of propagation, and wherein the respective connections between the respective fins and the frame are substantially parallel to proximal edges of the first patch radiator at least in part.

18. The antenna of claim 15, wherein the first patch radiator, first backing conductor, first parasitic, and the frame are maintained in a fixed spatial configuration with at least one mounting standoff, wherein the at least one mounting standoff is substantially nonconductive and exhibits dissipation and distortion of electrical energy in the frequency range of the antenna sufficiently low to permit operation of the antenna with a prescribed power level.

19. The antenna of claim 15, further comprising a conductive enclosure surrounding the power divider and the interconnecting feed lines at least in part, and positioned distal to the first patch radiator with reference to the frame.

20. The antenna of claim 12, wherein the power divider further comprises a second two output ports, substantially identical to the first two output ports, having prescribed signal levels and phase characteristics.

* * * * *